US007939477B2

(12) United States Patent
Hashida et al.

(10) Patent No.: US 7,939,477 B2
(45) Date of Patent: May 10, 2011

(54) LUBRICANT COMPOSITION FOR OIL-IMPREGNATED SINTERED BEARINGS

(75) Inventors: Miyuki Hashida, Ibaraki (JP); Toshio Nitta, Ibaraki (JP)

(73) Assignee: NOK Kluber Co., Ltd., Tokyo (JP)

( * ) Notice: Subject to any disclaimer, the term of this patent is extended or adjusted under 35 U.S.C. 154(b) by 141 days.

(21) Appl. No.: 12/297,461

(22) PCT Filed: Mar. 28, 2007

(86) PCT No.: PCT/JP2007/056543

§ 371 (c)(1), (2), (4) Date: Oct. 17, 2008

(87) PCT Pub. No.: WO2007/122969

PCT Pub. Date: Nov. 1, 2007

(65) Prior Publication Data

US 2009/0105105 A1 Apr. 23, 2009

(30) Foreign Application Priority Data

Apr. 20, 2006 (JP) ..... 2006-116261

(51) Int. Cl.

| | |
|---|---|
| ***C10M 169/00*** | (2006.01) |
| ***C10M 157/02*** | (2006.01) |
| ***C10M 157/04*** | (2006.01) |
| ***C10M 149/06*** | (2006.01) |

(52) U.S. Cl. ..... 508/182; 508/555

(58) Field of Classification Search ..... 508/181, 508/182, 555

See application file for complete search history.

(56) References Cited

U.S. PATENT DOCUMENTS

| | | | | |
|---|---|---|---|---|
| 4,174,461 | A | 11/1979 | Sianesi et al. | |
| 4,278,776 | A * | 7/1981 | Mauro et al. | 525/178 |
| 4,902,538 | A * | 2/1990 | Piacenti et al. | 427/393.6 |
| 5,045,158 | A * | 9/1991 | Chittofrati et al. | 205/352 |
| 6,420,321 | B1 * | 7/2002 | Akiyama et al. | 508/259 |
| 2008/0032904 | A1 * | 2/2008 | Watanabe et al. | 508/590 |

FOREIGN PATENT DOCUMENTS

| | | | |
|---|---|---|---|
| JP | 63-195416 | | 8/1988 |
| JP | 01-265048 | | 10/1989 |
| JP | 05-240251 | | 9/1993 |
| JP | 09-260128 | | 10/1997 |
| JP | 2001-200280 | | 7/2001 |
| JP | 2001-207186 | | 7/2001 |
| JP | 2003096480 | A * | 4/2003 |
| JP | 2003-147380 | | 5/2003 |
| JP | 2003-176831 | | 6/2003 |
| JP | 2003176831 | A * | 6/2003 |
| JP | 2004-108442 | | 4/2004 |
| JP | 2004108442 | A * | 4/2004 |
| WO | WO 2006/030632 | | 3/2006 |
| WO | WO 2006030632 | A1 * | 3/2006 |

OTHER PUBLICATIONS

Fomblin Product PFPE Data Sheet.*

* cited by examiner

*Primary Examiner* — Glenn A Caldarola
*Assistant Examiner* — Pamela Weiss
(74) *Attorney, Agent, or Firm* — Brinks Hofer Gilson & Lione

(57) ABSTRACT

A lubricant composition for oil-impregnated sintered bearings, which comprises at least one base oil selected from a perfluoropolyether oil represented by the following general formula:

$$RfO(CF_2CF_2O)_m(CF_2O)_nRf$$

(where Rf is a perfluoroalkyl group having 1-5 carbon atoms, m+n=3-200, m:n=10-90:90-10), a perfluoropolyether oil represented by the following general formula:

$$RfO[CF(CF_3)CF_2O]_p(CF_2CF_2O)_q(CF_2O)_rRf$$

(where Rf is a perfluoroalkyl group having 1-5 carbon atoms, p+q+r=3-200, q and r each may be 0, and (q+r)/p=0-2), and a polyfluoropolyether oil represented by the following general formula:

$$F(CF_2CF_2CF_2O)_sC_2F_5$$

(where s=2-100), and a fluorine-containing di- or mono-amide-based compound, has further improved lubrication characteristics, particularly wear resistance and friction coefficient characteristics, of perfluoropolyether oil.

4 Claims, No Drawings

LUBRICANT COMPOSITION FOR OIL-IMPREGNATED SINTERED BEARINGS

RELATED APPLICATIONS

The present application is a 35 U.S.C. §371 national stage filing of International Patent Application No. PCT/JP2007/056543, filed Mar. 28, 2007, to which priority is claimed under 35 U.S.C. §120 and through which priority is claimed under 35 U.S.C. §119 to Japanese Priority Patent Application No. 2006-116261, filed Apr. 20, 2006.

TECHNICAL FIELD

The present invention relates to a lubricant composition for oil-impregnated sintered bearings, and more particularly to a lubricant composition for oil-impregnated sintered bearings with distinguished wear resistance and low-friction coefficient characteristics.

BACKGROUND ART

Oil-impregnated sintered bearings are a kind of plain bearings comprising porous bodies made by pressing and heating metallic powders typically powders of copper, iron, tin, zinc or the like, which are impregnated with a lubricating oil, and are used in a self-oiling state. In spite of the low cost, the oil-impregnated sintered bearings are of relatively low friction and can be processed with a high precision in a self-lubricating system, and thus have been widely used as motor bearings in every parts of automobile electrical components, audiovisual components, business machinery, household electrical appliances, and driving components for computer auxiliary memory devices.

Recent enhancement of performances of these machinery and components has also been imposing very severe requirements for performances to the oil-impregnated sintered bearings such as down-sizing, higher speed, and lower electric current level and lower electric power consumption. To meet these requirements, it is not only important for the bearing manufacturers to further study the bearing materials, etc. on one hand, but also important to study further improvement of lubricating oil, because the characteristics or life of motors are largely dependent on performances of a few milligrams of lubricating oil impregnated and retained in the bearings on the other hand.

Characteristics required for the lubricating oil for the oil-impregnated sintered bearings include, for example, good compatibility with bearing materials (no generation of corrosion, sludges, etc.), for example, in the case of automobile application, availability in a wide temperature range such as −40° to +180° C. (low evaporation loss and good oxidation stability at high temperature, and no deterioration of flowability at low temperature), good anti-rust property, and substantially no adverse effect on resin parts, low friction coefficient and good wear resistance to meet the recent requirements such as the down-sizing, lower electric current level and longer life.

Perfluoropolyether oil has a distinguished heat stability, low volatility and chemical resistance, substantially no adverse effect on resin parts, and a distinguished temperature-viscosity characteristic, thus enabling application as a suitable lubricating oil for the oil-impregnated sintered bearing. In this connection, the following Patent Literature 1 proposes oil-impregnated sintered bearings impregnated with a perfluoropolyether oil to attain the desired stability of lubricating characteristics and prolonged bearing life on the basis of the low volatility of perfluoropolyether oil.

Patent Literature 1: JP-A-5-240251

However, the perfluoropolyether oil has such disadvantages as high wettability and diffusivity due to the low surface tension. Thus, its high leakability and scatterability have often caused problems. The oil-impregnated sintered bearing has been endowed with a longer life by impregnating and holding a lubricant in the pores of the bearing, thereby slowly oozing the lubricant to the sliding surface, but the above-mentioned properties of perfluoropolyether oil, i.e. high leakability and scatterability cause the oil to ooze out from the bearing more rapidly than as required, resulting in earlier consumption of the oil as held in the bearing, thereby shortening the life of bearing. Furthermore, the oil oozed out from the bearing will inevitably pollute the surrounding circumstances other than where desired.

The following Patent Literature 2, on the other hand, proposes a porous bearing filled with a grease containing at least 0.1% of a thickener. However, when the fiber width or particle sizes of the thickener are larger than pore sizes of the oil-impregnated sintered bearing, the thickener itself can hardly enter into the pores of the oil-impregnated sintered bearing, or rather will promote pollution of bearing circumstances.

Patent Literature 2: JP-A-63-195416

Perfluoropolyether oil also has a poor compatibility with metals, as compared with ordinary synthetic oil such as ester oil or synthetic hydrocarbon oil, and thus cannot form a satisfactory oil film for lubrication under severe conditions, so that it is less satisfactory than the ordinary synthetic oils in respect to wear resistance and friction resistance. The anti-rust property of perfluoropolyether oil is much more deteriorated thereby than that of the ordinary synthetic oil. When an additive is added thereto to overcome the above-mentioned problems, the perfluoropolyether oil has, however, a poor compatibility with non-fluorine-based additives so far used in most of the ordinary synthetic oils. Even if the perfluoropolyether oil is mixed with so far proposed various fluorine-based additives, on the other hand, it is hard to attain satisfactory wear resistance, low friction coefficient characteristics and anti-rust property.

The present applicant has so far proposed a lubricant composition for oil-impregnated sintered bearings, which comprises a base oil consisting of specific two kinds of polyfluoropolyether oils, and fluororesin powders having primary particle sizes of not more than 1 μm. The lubricant composition, when used in oil-impregnated sintered bearings, can improve the wear resistance, low friction coefficient, scattering-leaking resistance, and anti-rust property. Recently, requirements for lower torque have been imposed, while keeping the above-mentioned performances at the satisfactory level. Thus, further improvement of wear resistance and low friction coefficient characteristics has been now a new task.

Patent Literature 3: JP-A-2003-147380

DISCLOSURE OF THE INVENTION

Problem to be Solved by the Invention

The object of the present invention is to provide a lubricant for oil-impregnated sintered bearings with further improved lubrication characteristics, particularly wear resistance and low friction coefficient characteristics, of perfluoropolyether oil.

Means for Solving the Problem

The object of the present invention can be attained by a lubricant composition for oil-impregnated sintered bearings, which comprises a least one base oil selected from (A) perfluoropolyether oil represented by the following general formula:

$$RfO(CF_2CF_2O)_m(CF_2O)_nRf$$

(where Rf is a perfluoro lower alkyl group having 1-5 carbon atoms, m+n=3-200, and m:n=10-90:90-10, the $CF_2CF_2O$ group and the $CF_2O$ group being bonded at random in the main chain), (B) perfluoropolyether oil represented by the following general formula:

$$RfO[CF(CF_3)CF_2O]_p(CF_2CF_2O)_q(CF_2O)_rRf$$

(where Rf is a perfluoro lower alkyl group having 1-5 carbon atoms, p+q+r=3-200, q and r each may be 0, and (q+r)/p=0-2, and the $CF(CF_3)CF_2O$ group, the $CF_2CF_2O$ group, and the $CF_2O$ group being bonded at random in the main chain), and (C) perfluoropolyether oil represented by the following general formula:

$$F(CF_2CF_2CF_2O)_sC_2F_5$$

(where s=2-100), and a fluorine-containing di- or monoamide-based compound.

EFFECT OF THE INVENTION

The present lubricant composition for oil-impregnated sintered bearings has distinguished lubrication characteristics, particularly wear resistance and low friction coefficient characteristic, and are particularly suitable for use in gears, chain bushes, etc.

BEST MODES FOR CARRYING OUT THE INVENTION

Perfluoropolyether oils (A), (B) and (C) can be obtained in the following manner, where the perfluoro lower alkyl group Rf having 1-5 carbon atoms for use herein includes generally a perfluoromethyl group, a perfluoroethyl group, a perfluoropropyl group, etc.

Perfluoropolyether Oil (A):

Obtainable by complete fluorination of a precursor formed by photooxidation polymerization of tetrafluoroethylene. Those whose kinematic viscosity at 40° C. is in a range of 2-500 $mm^2$/sec can be used, which can satisfy conditions of m+n=3-200 and m:n=10-90:90-10 in the general formula of perfluoropolyether oil (A).

Perfluoropolyether Oil (B)

Obtainable by complete fluorination of a precursor formed by photooxidation polymerization of hexafluoropropylene or together with tetrafluoroethylene, or by anionic polymerization of hexafluoropropylene oxide or together with tetrafluoroethylene oxide in the presence of a cesium fluoride catalyst, followed by treatment of the resulting $CF(CF_3)COF$ group-terminated acid fluoride compound with a fluorine gas. Those whose kinematic viscosity at 40° C. is in a range of 2-1,300 $mm^2$/sec can be used, which can satisfy conditions of p+q+r=3-200 and (q+r)/p=0-2 in the general formula of perfluoropolyether oil (B).

Perfluoropolyether Oil (C)

Obtainable by anionic polymerization of 2,2,3,3-tetrafluorooxetane in the presence of a cesium fluoride catalyst, followed by treatment of the resulting fluorine-containing polyether $(CH_2CF_2CF_2O)_n$ with a fluorine gas under ultraviolet ray irradiation at 160°-300° C. Those whose kinematic viscosity at 40° C. is in a range of 2-500 $mm^2$/sec. can be used, which can satisfy the condition of s=2-100 in the general formula of perfluoropolyether oil (C).

In the lubricant composition for oil-impregnated sintered bearings, a fluorine-containing amide-based compound as an additive is added to at least one of the afore-mentioned perfluoropolyether oils. The fluorine-containing amide-based compound is added thereto in a proportion of 0.01-50% by weight on the basis of sum total of base oil and the fluorine-containing amide-based compound. That is, 0.01-50% by weight, preferably 0.1-40% by weight of at least one of the fluorine-containing amide-based compound additives is added to 50-99.99% by weight, preferably 60-99.9% by weight of at least one of perfluoropolyether oils (A)-(C). When the fluorine-containing amide-based compound is added in a proportion of less than 0.01% by weight, the desired improvement of lubrication characteristics of the present invention cannot be attained, whereas in a proportion of more than 50% by weight the properties of the lubricant proper will be deteriorated.

The fluorine-containing amide-based compound for use as an additive to the perfluoropolyether oils is generally at least one of fluorine-containing diamide-based compounds having a perfluoropolyether group and fluorine-containing monoamide-based compounds having a perfluoropolyether group, and includes, for example, aliphatic amide-based compounds having the following general formulae [I], [II], [III] and [IV]:

$$RCONHR_1NHCOR \quad [I]$$

$$R_2NHCOR \quad [II]$$

$$R_2NHCOR'CONHR_2 \quad [III]$$

$$RCONHR_1NR_3R_4 \quad [IV]$$

where $R_1$: an alkylene group having 1-30 carbon atoms, some or all of the hydrogen atoms of the alkylene group being replaceable with halogen atoms;

$R_2$: an alkyl group having 1-31 carbon atoms, some or all of the hydrogen atoms of the alkyl group being replaceable with halogen atoms;

$R_3$ and $R_4$ each: a hydrogen atom or an alkyl group having 1-3 carbon atoms;

R: $RfO[CF(CF_3)CF_2O]_aCF(CF_3)$—, $RfO(CF_2CF_2CF_2O)_aCF_2CF_2$—, $RfO[(CF_2CF_2O)_a(CF_2O)_b]CF_2$—, or $RfO[(CF_2CF_2O)_a(CF_2O)_b]CF(CF_3)$—, where Rf is a perfluoro lower alkyl group having 1-5 carbon atoms, preferably 1-3 carbon atoms, and a and b each are an integer of 1-30;

R': —$[CF(CF_3)CF_2O]_aCF(CF_3)$—, —$(CF_2CF_2CF_2O)_aCF_2CF_2$—, —$[(CF_2CF_2O)_a(CF_2O)_b]CF_2$—, or —$[(CF_2CF_2O)_a(CF_2O)_b]CF(CF_3)$—, and a and b each is an integer of 1-30.

Perfluoropolyether base oil to be admixed with the fluorine-containing amide-based compound has a kinematic viscosity at 40° C. of 2-2,000 $mm^2$/sec., preferably 5-1,500 $mm^2$/sec. When the kinematic viscosity is less than 2 $mm^2$/sec., it will be highly possible to cause shortened life, or occurrence of wear or seizure, due to increased evaporation loss, or decreased oil film strength, etc., whereas when the kinematic viscosity is more than 2,000 $mm^2$/sec. it will be highly possible to cause such inconveniences of increased power consumption or torque due to increased viscous resistance, etc.

A thickener can be added to the base oil together with the fluorine-containing amide-based compound. The thickener for use in the present invention includes preferably those so far used as a lubricant such as polytetrafluoroethylene, tetrafluoroethylene-hexafluoropropene copolymer, perfluoroalkylene resin, etc. Polytetrafluoroethylene is the one prepared by emulsion polymerization, suspension polymerization, solution polymerization, etc. of tetrafluoroethylene, followed by thermal decomposition, electronic beam irradiation decomposition, physical pulverization, etc. to give a number average molecular weight Mn of about 1,000 to about 1,000,000. Copolymerization reaction of tetrafluoroethylene and hexafluoropropene and the successive molecular weight reduction treatment can be carried out in the same manner as in the case of polytetrafluoroethylene, resulting in tetrafluoroethylene-hexafluoropropene copolymer having a number average molecular weight Mn of 1,000 to about 600,000. The molecular weight can be also controlled during the copolymerization reaction, using a chain transfer agent. The resulting powdery fluoro resins have generally an average primary particle size of not more than about 500 μm, preferably about 0.1 to about 30 μm.

Other thickeners than the fluoro resins can be used in the present invention, for example, metal soap such as Li soap, Li complex soap, etc.; urea compounds; minerals such as bentonite, etc.; organic pigments; and thermoplastic resins such as polyethylene, polypropylene, polyamide, etc. From the viewpoint of heat resistance and lubricability, it is preferable to use metal salts of aliphatic dicarboxylic acids, monoamidomonocarboxylic acids, or monoestercarboxylic acids, diurea, triurea, tetraurea, polyurea, etc., where urea compounds are compounds represented by the following general formula:

$$R'(NHCONHR)_nNHCONHR''$$

R: a divalent aromatic hydrocarbon group

R', R": a monovalent aliphatic saturated or unsaturated hydrocarbon group of $C_6$-$C_{24}$, an alicyclic hydrocarbon group, or an aromatic hydrocarbon group;

n=1 means a diurea compound, n=2 a triurea compound, n=3 a tetraurea compound, and n=4 or more polyurea compounds.

The thickener such as the fluoro resin powders, metal soap, urea compounds, or other thickeners can be added in a proportion of not more than 50% by weight, generally 0.1-50% by weight, preferably 1-40% by weight, on the basis of sum total of the base oil, the fluorine-containing amide-based compound as an additive, and the thickener. When the thickener is used in a proportion of more than 50% by weight, the composition will be too hard, whereas in a proportion of less than 0.1% by weight the thickening effect of the fluoro resin, etc. will not be obtained, resulting in worsening oil release, and any scattering and leaking prevention can be no more obtained.

Other additives so far used in the lubricant such as an antioxidant, a rust preventive, a corrosion inhibitor, an extreme pressure agent, an oiliness agent, other solid lubricants that the fluoro resins, etc. can be added to the composition, if required. The antioxidant includes, for example, phenol-based antioxidants such as 2,6-di-t-butyl-4-methylphenol,4,4'-methylenebis(2,6-di-t-burtylphenol), etc., and amine-based antioxidants such as alkyldiphenylamine, triphenylamine, phenyl-α-naphthylamine, alkylated phenyl-α-naphthylamine, phenothiazine, alkylated phenothiazine, etc.

The rust preventive includes, for example, fatty acids, fatty acid amines, metal salts of alkylsulfonic acids, alkylsulfonic acid amine salts, oxidated paraffin, polyoxyethylene alkyl ethers, etc., and the corrosion inhibitor includes, for example, benzotriazole, benzimidazole, thiadiazole, etc.

The pressure extreme agent includes, for example, phosphorus-based compounds such as phosphate esters, phosphite esters, phosphate ester amine salts, etc.; sulfur-based compounds such as sulfides, disulfides, etc.; metal salts of sulfur-based compounds such as metal salts of dialkyldithiophosphoric acids, dialkyldithiocarbamic acids, etc.

The oiliness agent includes, for example, fatty acids or their esters, higher alcohols, polyhydric alcohols or their esters, aliphatic amines, fatty acid monoglycerides, etc.

Other solid lubricant than the fluoro resins such as molybdenum disulfide, graphite, boron nitride, silane nitride, etc. can be also used as the additive.

The composition can be prepared by adding predetermined amounts of the fluorine-containing organic amide-based compounds as synthesized in advance, thickener, and other necessary additives to the perfluoropolyether base oil, followed by sufficient kneading by the ordinary dispersion method, for example, through three rolls or high pressure homogenizer.

EXAMPLES

The present invention will be described in detail below, referring to Examples.

Examples 1-16

| [Perfluoropolyether oils (base oil)] | | |
|---|---|---|
| A-1:$RfO(CF_2CF_2O)_m(CF_2O)_nRf$ | kinematic visxosity (40° C.) | 94 $mm^2$/sec. |
| A-2:$RfO(CF_2CF_2O)_m(CF_2O)_nRf$ | kinematic visxosity (40° C.) | 159 $mm^2$/sec. |
| A-3:$RfO[CF(CF_3)CF_2O]_p(CF_2O)_rRf$ | kinematic visxosity (40° C.) | 204 $mm^2$/sec. |
| A-4:$RfO[CF(CF_3)CF_2O]_pRf$ | kinematic visxosity (40° C.) | 169 $mm^2$/sec. |
| A-5:$RfO[CF(CF_3)CF_2O]_pRf$ | kinematic visxosity (40° C.) | 390 $mm^2$/sec. |
| A-6:$F(CF_2CF_2CF_2O)_sC_2F_5$ | kinematic visxosity (40° C.) | 93 $mm^2$/sec. |
| A-7:$F(CF_2CF_2CF_2O)_sC_2F_5$ | kinematic visxosity (40° C.) | 196 $mm^2$/sec. |

[Additive]

B-1: $C_3F_7O[CF(CF_3)CF_2O]_{12}CF(CF_3)CONHC_6H_{12}NH_2$ (above compound [IV])

B-2: $C_3F_7O[CF(CF_3)CF_2O]_aCF(CF_3)CONHC_6H_{12}NHCOCF(CF_3)[OCF_2CF(CF_3)]_{14}OC_3F_7$ (above compound [I])

B-3: $CF_3O[CF(CF_3)CF_2O]_{12}CF(CF_3)CONHCH_2CH_3$ (above compound [II])

B-4: $CH_3CH_2NHCO(CF_2CF_2CF_2O)_2CF_2CF_2CONHCH_2CH_3$ (above compound [III])

[Thickener]

C-1: Emulsion polymerization process polytetrafluoroethylene (number average molecular weight Mn: about $100\times10^3$ to about $200\times10^3$; average primary particle size: 0.2 μm)

C-2: Suspension polymerization process polytetrafluoroethylene (number average molecular weight Mn: about $10\times10^3$ to about $100\times10^3$; average primary particle size: 5 μm)

C-3: Solution polymerization process tetrafluoroethylene-hexafluoropropene copolymer (number average molecular weight Mn: about $50\times10^3$ to about $150\times10^3$; average primary particle size: 0.2 μm)

The foregoing base oil, additive and thickener were combined together and prepared into perfluoropolyether oil compositions in a procedure as mentioned before, and the performances of the compositions were evaluated according to the following testing procedures:

[Wear Resistance Evaluation Test Against Mating Material]

Wear test of a test piece of SUJ2(½ inch) of grade 20 was conducted by a Shell 4-ball test machine under conditions of number of revolutions: 20 revolution/sec., load: 392.3N (40 kgf), temperature: room temperature, testing time: 60 min. and wear mark diameter (unit: mm) was measured after the test

[Friction Coefficient Evaluation Test]

Friction coefficient was determined by a Soda's pendulum type friction test machine under conditions of temperature: room temperature and loads: 80 g at both edges and 40 g at the center Results of the foregoing tests are shown in the following Table 1 (for Examples) and Table 2 (for Comparative Examples) together with composition (% by weight) and amount of the base oil as used, species and amount of the additives as used, and species and amount of the thickener as used.

TABLE 1

| | Base oil | | Additive | | Thickener | | | |
|---|---|---|---|---|---|---|---|---|
| Ex. No. | Composition | Parts By wt. | Species | Parts by wt. | Species | Parts by wt. | Wear mark size | Friction coefficient |
| 1 | A-2 (100) | 97 | B-1 | 3 | — | — | 0.9 | 0.10 |
| 2 | A-5 (100) | 97 | B-3 | 3 | — | — | 1.1 | 0.12 |
| 3 | A-1 (80)<br>A-4 (20) | 97 | B-1 | 3 | — | — | 0.9 | 0.11 |
| 4 | A-1 (40)<br>A-5 (60) | 95 | B-1 | 5 | — | — | 0.9 | 0.11 |
| 5 | A-1 (30)<br>A-6 (70) | 97 | B-3 | 3 | — | — | 0.8 | 0.12 |
| 6 | A-2 (60)<br>A-7 (40) | 99 | B-2 | 1 | — | — | 1.1 | 0.11 |
| 7 | A-4 (40)<br>A-6 (60) | 93 | B-1 | 7 | — | — | 0.6 | 0.12 |
| 8 | A-5 (20)<br>A-7 (80) | 97 | B-1 | 3 | — | — | 0.7 | 0.11 |
| 9 | A-3 (100) | 96 | B-2 | 1 | C-1 | 3 | 0.8 | 0.12 |
| 10 | A-4 (100) | 90 | B-1 | 5 | C-2 | 5 | 0.6 | 0.12 |
| 11 | A-5 (100) | 94 | B-1 | 3 | C-1 | 3 | 0.9 | 0.11 |
| 12 | A-6 (100) | 96 | B-2 | 3 | C-3 | 1 | 0.9 | 0.11 |
| 13 | A-2 (80)<br>A-4 (20) | 94 | B-1 | 3 | C-1 | 3 | 0.9 | 0.11 |
| 14 | A-2 (70)<br>A-5 (30) | 94 | B-2 | 3 | C-1 | 3 | 0.9 | 0.11 |
| 15 | A-2 (50)<br>A-5 (50) | 94 | B-1 | 3 | C-1 | 3 | 1.1 | 0.11 |
| 16 | A-2 (20)<br>A-5 (80) | 94 | B-1 | 3 | C-1 | 3 | 1.1 | 0.12 |
| 17 | A-2 (40)<br>A-3 (60) | 93 | B-2 | 5 | C-3 | 2 | 1.2 | 0.11 |
| 18 | A-2 (80)<br>A-4 (20) | 99 | B-4 | 1 | — | — | 0.8 | 0.11 |
| 19 | A-2 (80)<br>A-4 (20) | 96 | B-4 | 1 | C-1 | 3 | 0.9 | 0.11 |

TABLE 2

| | Base oil | | Thickener | | Wear | |
|---|---|---|---|---|---|---|
| Comp. Ex. No. | Composition | Parts by wt. | Species | Parts by wt. | mark size | Friction coefficient |
| 1 | A-2 (100) | 100 | — | — | 1.6 | 0.11 |
| 2 | A-5 (100) | 100 | — | — | 1.5 | 0.13 |
| 3 | A-1 (80)<br>A-4 (20) | 100 | — | — | 1.4 | 0.12 |
| 4 | A-1 (40)<br>A-5 (60) | 100 | — | — | 1.5 | 0.13 |
| 5 | A-1 (30)<br>A-6 (70) | 100 | — | — | 1.2 | 0.13 |
| 6 | A-2 (60)<br>A-7 (40) | 100 | — | — | 1.6 | 0.12 |
| 7 | A-4 (40)<br>A-6 (60) | 100 | — | — | 0.9 | 0.13 |
| 8 | A-5 (20)<br>A-7 (80) | 100 | — | — | 1.5 | 0.13 |
| 9 | A-3 (100) | 97 | C-1 | 3 | 1.0 | 0.15 |
| 10 | A-4 (100) | 95 | C-2 | 5 | 0.8 | 0.15 |
| 11 | A-6 (100) | 99 | C-3 | 1 | 1.1 | 0.13 |
| 12 | A-2 (80)<br>A-4 (20) | 97 | C-1 | 3 | 1.4 | 0.12 |
| 13 | A-2 (70)<br>A-5 (30) | 97 | C-1 | 3 | 1.5 | 0.12 |
| 14 | A-2 (50)<br>A-5 (50) | 99 | C-1 | 1 | 1.6 | 0.12 |
| 15 | A-2 (20)<br>A-5 (80) | 97 | C-1 | 3 | 1.5 | 0.13 |
| 16 | A-2 (40)<br>A-3 (60) | 98 | C-3 | 2 | 1.7 | 0.12 |

INDUSTRIAL UTILITY

The present lubricant composition for oil-impregnated sintered bearings can be used in power transmission units such as speed reducing-accelerating units, gears, chain bushes, motors, etc., relatively moving machine parts, internal combustion engines, vacuum pumps, valve, seal pneumatic units, oil-hydraulic working parts, machine tools such as motor-driven tools, business machine parts such as LBP scanner motors, etc., PC•HDD-related parts such as fan motors, spindle motors, etc., household electric precision machine parts such as VTR capstan motors, mobile telephone vibration motors, etc., various parts of metal processing units, transfer units, railways, ships and aircrafts, automobile auxiliaries (engine-related parts of fuel pumps, etc., suction•fuel-related parts of electronically controlled throttles, etc., exhauster parts such as exhaust gas circulating units, cooling system parts such as water pump, etc., air conditioning system parts such as air conditioners, etc., travelling system parts, control system parts of ABS, etc., steering system parts, driving system parts such as speed change gear etc., interior or exterior parts such as power window, optical axis-adjusting motors for head lights, door mirrors, etc.), and various parts in the food, pharmaceutical, iron and steel, construction, glass and cement industries, the chemical, rubber and resin industries such as film tenters, the environmental and power apparatus, the paper-making industry, the printing industry, the timber industry, and the textile-apparel industry.

Furthermore, the present lubricant composition can be used also in other bearings such as ball-and-roller bearings, thrust bearings, kinetic pressure bearings, resin bearings, direct-acting units, etc.

The invention claimed is:

1. A lubricant composition for oil-impregnated sintered bearings, which comprises at least one base oil selected from (A) a perfluoropolyether oil represented by the following general formula:

$$RfO(CF_2CF_2O)_m(CF_2O)_nRf$$

(where Rf is a perfluoro lower alkyl group having 1-5 carbon atoms, m+n=3-200, and m:n=10-90:90-10, the $CF_2CF_2O$ group and the $CF_2O$ group being bonded at random in the main chain), (B) a perfluoropolyether oil represented by the following general formula:

$$RfO[CF(CF_3)CF_2O]_p(CF_2CF_2O)_q(CF_2O)_rRf$$

(where Rf is a perfluoro lower alkyl group having 1-5 carbon atoms, p+q+r=3-200, q and r each may be 0, and (q+r)/p=0-2, the $CF(CF_3)CF_2O$ group, the $CF_2CF_2O$ group and the $CF_2O$ group being bonded at random in the main chain), and (C) a perfluoropolyether oil represented by the following general formula:

$$F(CF_2CF_2CF_2O)_sC_2F_5$$

(where s=2-100), and an amide-based compound having a perfluoropolyether group represented by the following general formula:

$$RCONHR_1NR_3R_4 \quad [IV]$$

(where R is $RfO[CF(CF_3)CF_2O]_aCF(CF_3)$—, $RfO(CF_2CF_2CF_2O)_aCF_2CF_2$—, $RfO[(CF_2CF_2O)_a(CF_2O)_b]CF_2$—, or $RfO[(CF_2CF_2O)_a(CF_2O)_b]CF(CF_3)$—, Rf is a perfluoro lower alkyl group having 1-5 carbon atoms, a and b each are an integer of 1-30, $R_1$ is an alkylene group having 1-30 carbon atoms, some or all of the hydrogen atoms of the alkylene group being replaceable with halogen atoms, and $R_3$ and $R_4$ each are a hydrogen atom or an alkyl group having 1-3 carbon atoms).

2. A lubricant composition for oil-impregnated sintered bearings according to claim 1, wherein the amide-based compound having a perfluoropolyether group is in a proportion of 0.01-50% by weight on the basis of sum total of perfluoropolyether base oil and the amide-based compound having a perfluoropolyether group.

3. A lubricant composition for oil-impregnated sintered bearings according to claim 1, wherein a thickener is further contained.

4. A lubricant composition for oil-impregnated sintered bearings according to claim 3, wherein the thickener is fluoro resin powders having a primary particle size of not more than 500 μm.

* * * * *